US010272971B2

(12) United States Patent
Levin

(10) Patent No.: US 10,272,971 B2
(45) Date of Patent: Apr. 30, 2019

(54) WATERCRAFT CANOPY FOR U-SHAPED DOCK

(71) Applicant: Designer Direct, Inc., Des Plaines, IL (US)

(72) Inventor: Kerry Levin, Des Plaines, IL (US)

(73) Assignee: Designer Direct, Inc., Des Plaines, IL (US)

( * ) Notice: Subject to any disclaimer, the term of this patent is extended or adjusted under 35 U.S.C. 154(b) by 0 days.

(21) Appl. No.: 15/815,702

(22) Filed: Nov. 16, 2017

(65) Prior Publication Data

US 2018/0111663 A1 Apr. 26, 2018

Related U.S. Application Data

(63) Continuation-in-part of application No. 15/686,095, filed on Aug. 24, 2017, which is a continuation of
(Continued)

(51) Int. Cl.
*E04H 15/18* (2006.01)
*B63B 17/02* (2006.01)
(Continued)

(52) U.S. Cl.
CPC ..... *B63B 17/02* (2013.01); *E04H 15/06* (2013.01); *E04H 15/18* (2013.01); *E04H 15/36* (2013.01);
(Continued)

(58) Field of Classification Search
CPC ..... B63B 17/02; B63B 2017/026; B63B 2737/00; E04H 15/18; E04H 15/36
See application file for complete search history.

(56) References Cited

U.S. PATENT DOCUMENTS 302,535 A 7/1884 Holabird
394,262 A 12/1888 Gentzen
(Continued)

FOREIGN PATENT DOCUMENTS

CA 1289436 9/1991
CA 02088948 8/1994
(Continued)

OTHER PUBLICATIONS

Pier-port 4, Youtube Video, https://www.youtube.com/watch?v=ZFcdmitfB1Q, Dec. 26, 2014 (Includes dated web page print followed by page of still images summarizing video).
(Continued)

*Primary Examiner* — Noah Chandler Hawk
(74) *Attorney, Agent, or Firm* — Steven L. Fisher-Stawinski

(57) ABSTRACT

A canopy structure includes arch members defining a barrel vault and horizontal members. Each of the upper horizontal members is affixed to the parallel arch members. The canopy structure further includes arched vertical supports. The upper horizontal supports are affixed to the arched vertical supports. The canopy structure further includes lower horizontal members. Each of the lower horizontal members is affixed to the parallel arch members. According to another aspect, a canopy structure includes a U-shaped dock surrounding a watercraft mooring area. The canopy structure includes inner dock arm edges located on opposite sides of the watercraft mooring area. The canopy structure further includes vertical supports affixed to at least two of the inner dock arm edges. The vertical supports support a canopy frame. The canopy frame defines a barrel vault.

19 Claims, 14 Drawing Sheets

Related U.S. Application Data application No. 15/186,334, filed on Jun. 17, 2016, now Pat. No. 9,776,687.

(60) Provisional application No. 62/181,979, filed on Jun. 19, 2015.

(51) Int. Cl.

| | |
|---|---|
| ***E04H 15/36*** | (2006.01) |
| ***E04H 15/06*** | (2006.01) |
| ***E04H 15/54*** | (2006.01) |
| ***E04H 15/58*** | (2006.01) |
| *E04H 15/04* | (2006.01) |
| *E04H 15/02* | (2006.01) |

(52) U.S. Cl.

CPC ..... *E04H 15/54* (2013.01); *E04H 15/58* (2013.01); *B63B 2017/026* (2013.01); *B63B 2737/00* (2013.01); *E04H 15/02* (2013.01); *E04H 15/04* (2013.01)

(56) References Cited

U.S. PATENT DOCUMENTS 413,730 A 10/1889 Palmer
498,583 A 5/1893 Smawley
528,393 A 10/1894 Rinn
1,051,252 A 1/1913 Parker
1,158,356 A 10/1915 Wilson
1,388,478 A 8/1921 Nelson
1,448,821 A 3/1923 Andrews
1,625,016 A 2/1925 Scott
1,527,908 A 4/1925 Noble
1,538,296 A 5/1925 McDonald
1,593,431 A 7/1926 Buie
1,672,388 A 6/1928 McWilliam
1,953,514 A 4/1934 Skagerberg
2,182,283 A 12/1939 Curtis
2,708,346 A 5/1955 Smith
3,023,732 A 5/1959 Everett
2,912,703 A 11/1959 Murphy
2,930,387 A 3/1960 Streich
3,003,507 A 10/1961 Ferris
3,030,973 A * 4/1962 Janda ..... B63C 15/00 105/15
3,083,540 A 4/1963 Smith
3,242,620 A 3/1966 Kaiser
3,425,428 A 2/1969 Schwartz
3,441,037 A 4/1969 Transeau
3,869,836 A 3/1975 Allen
4,312,157 A 1/1982 Hertel
4,363,284 A 12/1982 Monroe
4,683,901 A 8/1987 Mitchell
4,898,198 A 2/1990 Castlebury
5,086,799 A 2/1992 Lumbleau
5,152,109 A 10/1992 Boers
5,185,972 A 2/1993 Markiewicz
5,314,377 A 5/1994 Pelosi
5,331,917 A 7/1994 Magers
5,419,273 A 5/1995 Cutler
5,425,327 A 6/1995 Zirkelbach
5,520,139 A 5/1996 King
5,573,026 A * 11/1996 Griffith ..... B63B 17/023 114/361
5,575,301 A 11/1996 Bolton
5,632,290 A 5/1997 Kuo
5,697,320 A 12/1997 Murray
5,709,501 A 1/1998 Elbers
5,775,353 A 7/1998 Johnson
5,904,114 A 5/1999 Wright
5,967,162 A 10/1999 Bolton
5,979,125 A 11/1999 Guillet
6,032,433 A 3/2000 Hatziathanasiou
6,073,587 A 6/2000 Hill
6,360,492 B1 3/2002 Ross
6,505,638 B1 1/2003 Powell
6,615,550 B2 9/2003 Reuschel
6,684,893 B2 2/2004 Kuo
6,688,252 B1 2/2004 Caravella
6,691,723 B2 2/2004 Godbersen
6,976,806 B2 12/2005 Edson
7,001,104 B2 2/2006 Edson
7,055,538 B2 6/2006 Deng
D530,022 S 10/2006 Haymann
7,353,769 B2 4/2008 Unrast
7,389,785 B2 * 6/2008 Loudermilk ..... E04H 15/18 135/120.3
7,392,816 B2 7/2008 Porter
7,401,569 B2 7/2008 Jones
D584,420 S 1/2009 Gibson
7,527,014 B2 5/2009 Hey
7,555,994 B1 7/2009 Arnall
7,669,542 B2 3/2010 Donahue
7,814,723 B2 10/2010 VanElverdinghe
7,913,710 B2 3/2011 Bougioukos
7,958,839 B2 6/2011 Donahue
8,286,651 B1 10/2012 Maffett
8,387,318 B2 3/2013 Kaufman
8,555,910 B2 10/2013 Webster
8,602,043 B2 12/2013 Kaiser
8,667,908 B2 3/2014 Martin
8,783,276 B2 7/2014 Skrzynski
8,789,549 B1 7/2014 Barnes
8,857,366 B2 10/2014 Russikoff
8,944,399 B2 3/2015 Sutherland
9,216,798 B2 12/2015 Kent
9,272,754 B1 3/2016 Craig
9,404,281 B1 * 8/2016 Donnay ..... E04H 15/36
9,556,640 B2 1/2017 Levin
9,777,504 B2 10/2017 Levin
9,926,720 B2 3/2018 Huang
2003/0062074 A1 3/2003 Kuo
2003/0084934 A1 5/2003 Goldwitz
2003/0131539 A1 7/2003 Burford
2003/0183275 A1 10/2003 Lee
2005/0016438 A1 1/2005 Hey
2005/0161071 A1 7/2005 Tseng
2005/0252542 A1 11/2005 Basta
2005/0259545 A1 11/2005 Yun
2007/0068634 A1 3/2007 Unrast
2007/0295379 A1 * 12/2007 Basta ..... B63C 5/00 135/122
2010/0122718 A1 5/2010 Lah
2011/0290292 A1 12/2011 Kaiser
2014/0026804 A1 1/2014 Templeton
2014/0331569 A1 * 11/2014 Spearn ..... E04F 10/00 52/74
2015/0308143 A1 10/2015 Levin
2016/0289989 A1 * 10/2016 Creagh ..... E04H 6/04
2016/0368571 A1 12/2016 Levin
2017/0096834 A1 4/2017 Levin
2017/0254038 A1 9/2017 Levin
2017/0284081 A1 * 10/2017 Craig ..... E04H 15/34

FOREIGN PATENT DOCUMENTS

| | | |
|---|---|---|
| CN | 204112218 | 1/2015 |
| DE | 102006019755 | 4/2006 |
| WO | WO2011157969 | 6/2011 |
| WO | WO2011140557 | 11/2011 |

OTHER PUBLICATIONS

Pier-port 6, Youtube Video, https://www.youtube.com/watch?v=p4oxEgZDreQ, Apr. 6, 2015 (Includes dated web page print followed by page of still images summarizing video).

Pier-port 6, Youtube Video, https://www.youtube.com/watch?v=-KR4u5i6ego, Apr. 7, 2015 (Includes dated web page print followed by page of still images summarizing video).

Pier-Port|Cantilevered Boat Canopy, Pier-port.com, The Internet Wayback Machine, May 9, 2015, https://web.archive.org/web/

(56) References Cited

OTHER PUBLICATIONS

20150509035441/http://pier-port.com/ (Prints and screenshots of dated snapshot).

* cited by examiner

WATERCRAFT CANOPY FOR U-SHAPED DOCK

BACKGROUND OF THE INVENTION

The invention relates generally to protective covers and shelters for watercraft and in particular to dock-mounted canopies. Boaters who moor their boats to piers universally face the task of repeatedly covering and then uncovering their watercraft between storage and use configurations.

Individual covers exist for most watercraft, but have to be manually taken on and off with various combinations of zippers, snaps, hook and loop fasteners, and center poles. This task can be time consuming and physically demanding, and, for users with dexterity-reducing disabilities, virtually impossible. Flat roof canopies require a boat lift or lakebed means of support, and don't allow headroom for the user to stand. Often times, boaters skip boating altogether because of the difficulty associated with manual covers and boat lifts. Reducing the work involved in transitioning between storage and use configurations can enhance the utility that watercraft users experience.

SUMMARY OF THE INVENTION

A canopy structure includes a plurality of parallel arch members defining a barrel vault and at least two upper horizontal members. Each of the upper horizontal members is affixed to at least two of the parallel arch members at an inner attachment point thereof. The canopy structure further includes at least two pluralities of arched vertical supports. The upper horizontal supports are affixed to the at least two pluralities of arched vertical supports. The canopy structure further includes at least two lower horizontal members. Each of the horizontal members is affixed to at least two of the parallel arch members at an outer attachment point thereof.

According to another aspect of the invention, a canopy structure includes a U-shaped dock surrounding a watercraft mooring area. The canopy structure includes at least two inner dock arm edges located on opposite sides of the watercraft mooring area. The canopy structure further includes at least two vertical supports affixed to at least two of the inner dock arm edges. The vertical supports support a canopy frame. The canopy frame defines a barrel vault.

According to another aspect of the invention, a canopy support includes a bracket. The bracket includes a vertically oriented bracket tube affixed to a bracket plate. The canopy support further includes a vertical member comprising a vertical member upper end and a vertical member lower end. The vertical member lower end is inserted into the vertically oriented bracket tube. A vertically oriented arch retention tube is affixed to the vertical member upper end. An arched support member includes an arched support member vertical lower end and an arched support member distal upper end. The arched support member vertical lower end is inserted into the vertically oriented arch retention tube. An upper tubular T-connector is affixed to said arch member distal upper end.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
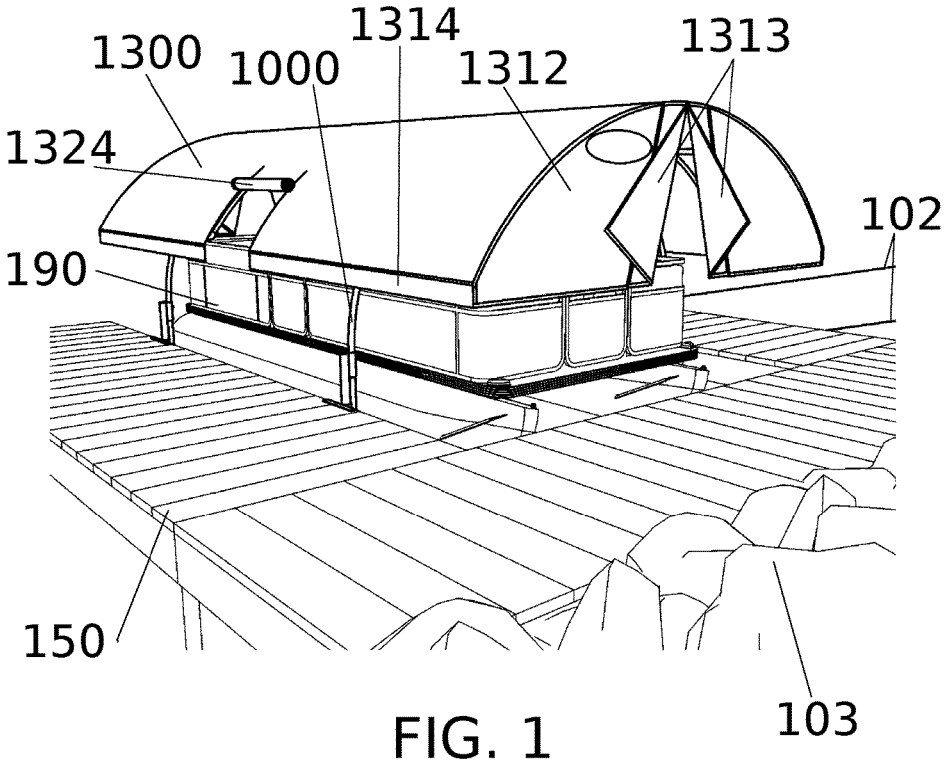
FIG. 1 is an elevated rear-left perspective scene view of a watercraft canopy installed on a U-shaped dock with an exemplary large watercraft moored therein, in accordance with at least one embodiment of the present invention.

Referring now to the invention in more detail, the invention is directed to a watercraft canopy with properties particularly adapted for installation on a U-shaped dock. As shown in FIGS. 1-4, the environment of the depicted embodiments is installation on a U-shaped dock 150 or pier such that a mooring area is surrounded on three sides by the back and arms of the dock, with the fourth side open and accessible to watercraft for ingress and egress to or from the body of water on which the U-shaped dock 150 is located. As depicted in FIGS. 1-4, defined within the environment are the water level 102 (the water level 102 is represented by a pair of parallel oblique lines, which define a plane within the perspective of the figures), the shore 103, and the water body bed 106 (the water body bed 106 is represented by short oblique line segments located at the base of the dock support poles 152; the water body bed 106 may be understood to extend in all directions under the body of water in the locale of installation). In general, the water body bed 106 may refer to the floor of any body of water in which the user wishes to moor watercraft—for example, a lake bed, riverbed, pond bed, seabed, etc., including the bed of an artificial body of water. While an aspect of the depicted embodiment, the presence of a U-shaped dock 150 or even a body of water are not required to practice the invention, which may be installed over a mooring area having no walking access (for example, using the auger pole support option of FIGS. 14A-14C), or over a location on dry land or otherwise with no water at all. In addition, embodiments of the invention may be installed adjacent to a linear or L-shaped dock, with one or more sides being supported from augur poles in the lake bed without an adjacent dock or pier structure.

Embodiments of the invention may provide covered mooring for large exemplary watercraft 190, for example the pontoon boat shown, as well as small exemplary watercraft 390 such as canoes, kayaks, or the depicted powered personal watercraft, or any other type of watercraft moorable at the U-shaped dock 150.

In various embodiments, the U-shaped dock 150 is a floating dock, which is thus allowed to move freely up and down as the water level 102 changes over time. Various embodiments of the invention may be fixed to the U-shaped dock 150 and allowed to vary with the water level 102 or fixed to the water body bed 106. Further, various embodiments are contemplated were the U-shaped dock is itself fixed to the water body bed 106 and/or the shore 103 such that the water level 102 changes relative to the height of the U-shaped dock and the particular embodiment of the invention.

Referring still to the embodiments depicted in FIGS. 1-4, at least two pluralities of vertical supports 1000 (in two rows, as shown) support a canopy frame 600 (FIG. 1-2) or 700 (FIGS. 3-4), which is covered by a canopy cover 1300. Access to moored watercraft is available through side door flaps 1324 or end door flaps 1313, the latter being of the overlap between end panels 1312.

Figure 10:
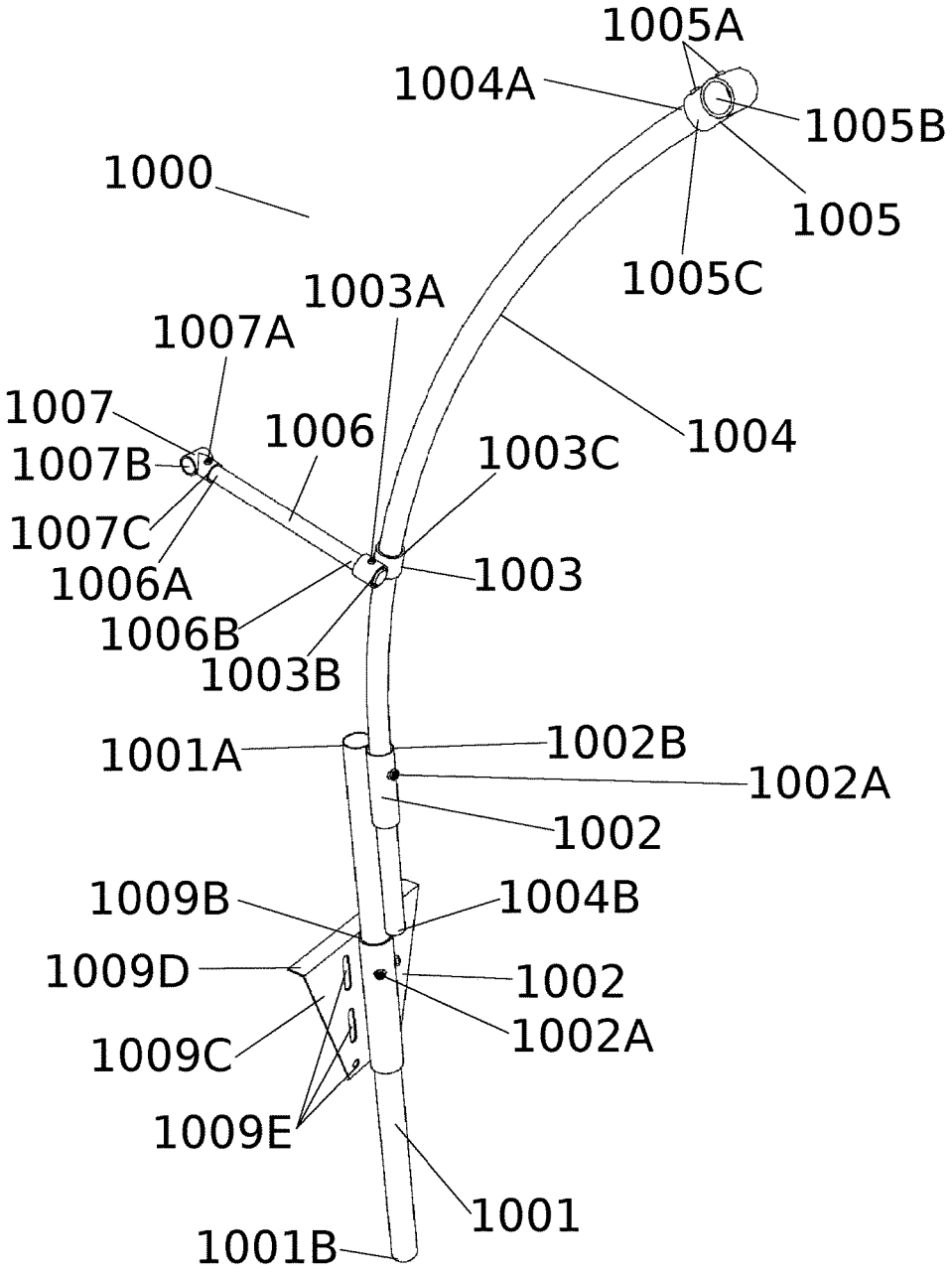
FIG. 10 is an elevated front-left perspective view of a canopy support, in accordance with at least one embodiment of the present invention.
Figure 11:
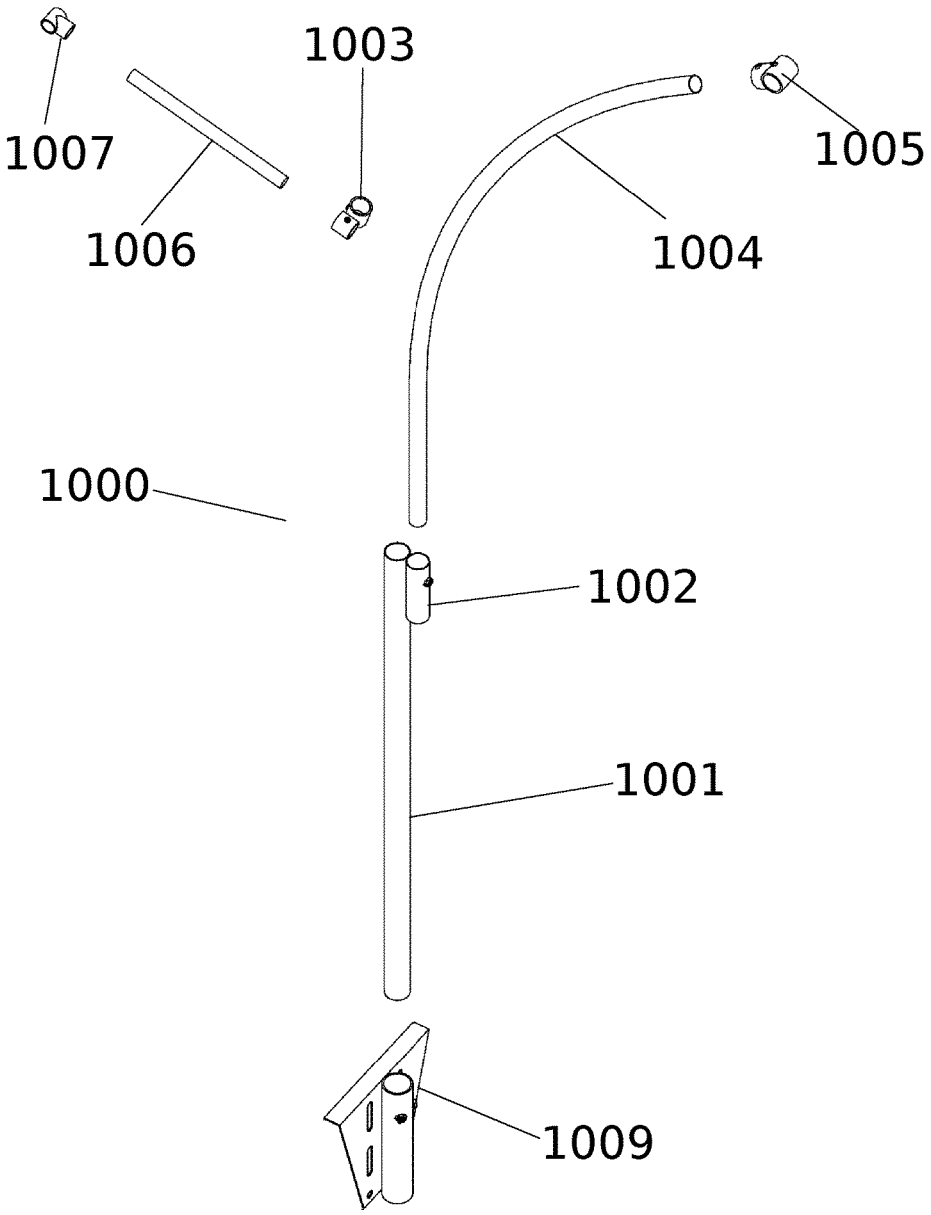
FIG. 11 is an exploded elevated front-left perspective view of a canopy support, in accordance with at least one embodiment of the present invention.

Referring now to the embodiment depicted in FIGS. 10-11, FIG. 10 depicts a vertical support 1000 (alternatively, a canopy support). FIG. 11 depicts an exploded view of the components of the vertical support 1000. Each vertical support 1000 includes a vertical member 1001 having a vertical member upper end 1001A and a vertical member lower end 1001B. Affixed to the vertical member upper end 1001A is a vertically oriented arch retention tube 1002 having an annular opening 1002B secured by an embedded bolt 1002A. An arched support member 1004 is vertical at the arch member vertical lower end 1004B and curved away from vertical, distally at the arch member distal upper end 1004A. The arch member vertical lower end 1004B is inserted into the vertically oriented arch retention tube 1002 via the annular opening 1002B and secured there with the embedded bolt 1002A.

Referring still to the embodiment of FIG. 10, affixed to the arch member distal upper end 1004A is an upper tubular T-connector 1005, which includes embedded bolts 1005A. At least one of the embedded bolts 1005A secures anything inserted through an upper tubular T-connector annular opening 1005B. At least one of the embedded bolts 1005A secures anything inserted into an upper tubular T-connector terminal opening 1005C. The arch member distal upper end 1004A is inserted into the upper tubular T-connector terminal opening 1004C and secured there by at least one of the embedded bolts 1005A.

Referring still to the embodiment of FIG. 10, a distal support member 1006, which includes a distal support member first end 1006A and a distal support member second end 1006B, may be affixed to centrally the arched support member 1004 via a tubular right angle connector 1003. The tubular right angle connector 1003 includes a first tubular right angle connector annular opening 1003B and a second tubular right angle connector annular opening 1003C, fixed at right angles to one another. The first tubular right angle connector annular opening 1003B conforms to the distal support member second end 1006B, which may be slidably inserted therein and releasably retained via one or more embedded bolts 1003A. The distal support member may thus be adjustably telescoped relative to the arched support member 1004 by sliding within the first tubular right angle connector annular opening 1003B. Similarly, the second tubular right angle connector annular opening 1003C conforms to the arched support member 1004, which is disposed therein allowing the tubular right angle connector 1003, and thus the distal support member 1006, to slide relative to the arched support member 1004. The arched support member 1004 may be releasably fixed to the tubular right angle connector 1003 via one or more embedded bolts 1003A.

Referring still to the embodiment of FIG. 10, affixed to the distal support member 1006 is a distal tubular T-connector 1007, which includes embedded bolts 1007A. At least one of the embedded bolts 1007A secures anything inserted through a distal tubular T-connector annular opening 1007B. At least one of the embedded bolts 1007A secures anything inserted into a distal tubular T-connector terminal opening 1007C. The distal support member first end 1006A is inserted into the distal tubular T-connector terminal opening 1007C and secured there by at least one of the embedded bolts 1007A.

The vertical supports 1000 may be affixed to a mounting surface, generally either the U-shaped dock 150 or the water body bed 106. In the depicted embodiment of FIGS. 1-4, the bracket 1009 is affixed to the U-shaped dock 150 using fasteners through the provided holes 1009E. The bracket plate 1009C and bracket lip 1009D are thus retained against the U-shaped dock 150. Optionally, a back plate may be fastened on the interior surface of the U-shaped dock 150 forming a clamp configuration with the bracket plate 1009C.

Referring now to the canopy frame of FIGS. 6-9 and FIG. 12, the vertical supports 1000 support the upper portions of the canopy frame 500, 600, 700, 800, or 900. In the depicted embodiment, the vertical supports 1000 support the entire upper portion of the canopy frame alone—that is, without any cross-bracing or other elements that would obstruct access to watercraft moored under the canopy frame or to ingress and egress through the ends of the barrel vault.

Referring still to the embodiments depicted in FIGS. 6-9 and FIG. 12, each of at least two upper horizontal members 514 are affixed the vertical supports 1000 in two rows as shown. Specifically, each row of vertical supports 100 is oriented with its arch members 1004 directed inward and supporting one of the upper horizontal members 514. For embodiments in which a U-shaped dock 150 is present, such as those depicted in FIGS. 1-4, "inward" may be understood as toward the central mooring area between the dock arms. Multiple upper horizontal support members 514 may be joined inline via a tubular linear connector 513, which joins upper horizontal supports 514 end-to-end, as shown. Each upper horizontal support 514 may be affixed to one or more of the vertical supports 1000 via the upper tubular T-connector 1005, with the upper horizontal support 514 inserted through the upper tubular T-connecter annular opening 1005B and secured there via one of the embedded bolts 1005A.

Figure 12:
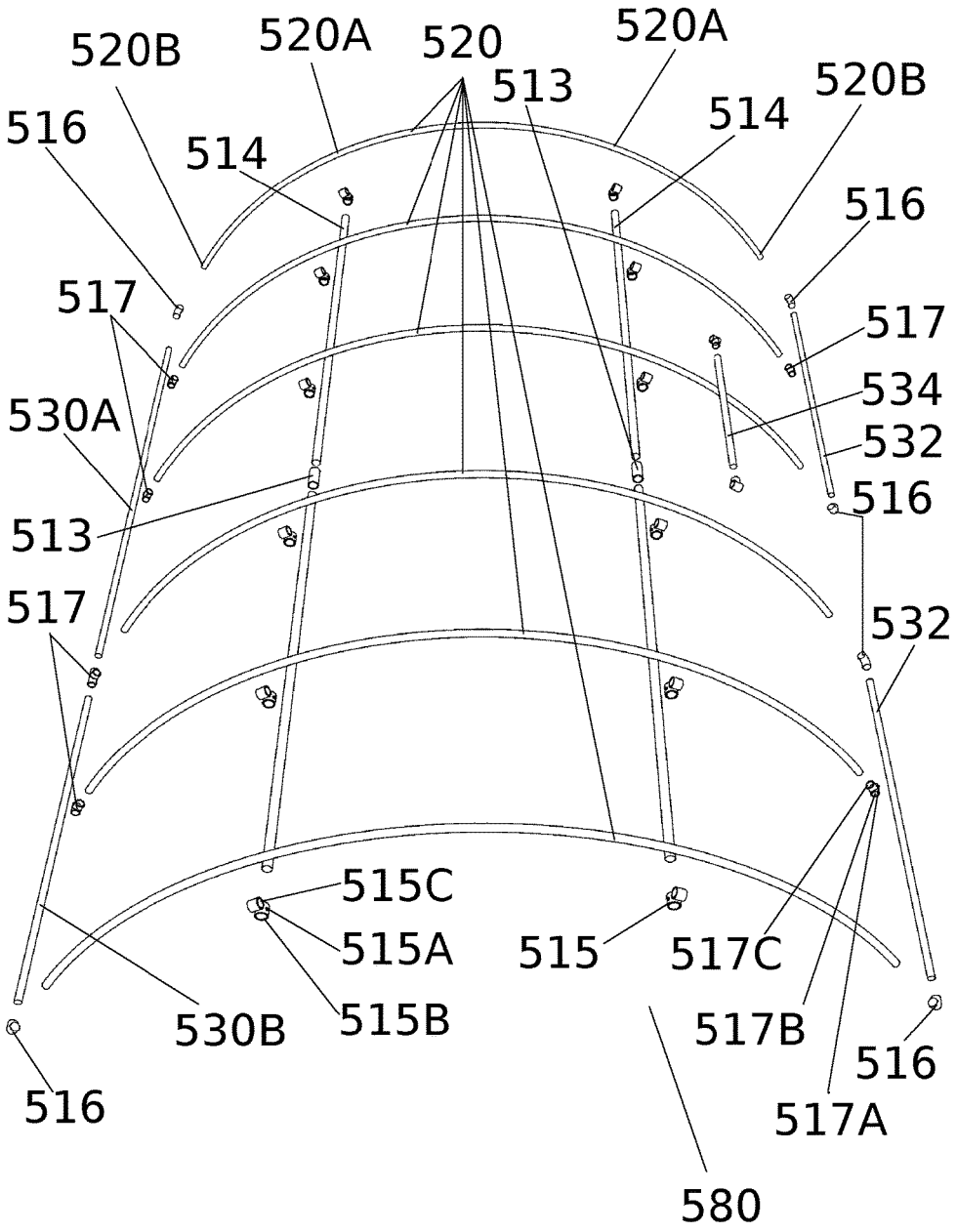
FIG. 12 is an exploded elevated view of the barrel vault elements of a canopy frame, in accordance with at least one embodiment of the present invention.

Referring still to the embodiment depicted in FIGS. 6-9, the canopy frame 500, 600, 700, 800, or 900 includes a plurality of arch members 520, which define a barrel vault 580 (shown in the exploded view of FIG. 12, as distinct from the overall canopy frame 500). The arch members 520 may be arch-shaped as shown, or may be constructed with hard lines and angles. More particularly, the arch members 920 may be shaped so as to define an arc that intersects both of the upper horizontal supports 514. Each arch member 520 may be slidably affixed to the at least two upper horizontal members via an arch tubular right angle connector 515, the location of each defining an inner attachment point ("inner", being understood to be relatively near the center of the arch members 520). The inner attachment point may thus be understood to be adjustable along the plurality of arch members 520.

Such an arc may be understood as downwardly concave and lacking any inflection points, as shown. As used herein, "downwardly concave" means that the outside edge, relative to the arc, of any downwardly concave element is oriented vertically higher than the inside edge, relative to the arc. Equivalently, as shown in FIGS. 6-9, the arch members 520 are oriented in planes parallel to on another so as to define a barrel vault 580; that is, the arc defined by the arch members 520 may be extruded along a dimension defined by the upper horizontal members 514. The defined barrel vault 580 may be understood to have a first barrel vault end 581 and a second barrel vault end 582, which may be understood as the flat and vertical faces at either end of the extruded dimension of the barrel vault 580, which, in the embodiment of FIGS. 6-9, are unobstructed by any frame members. Further, the barrel vault 580 may be sufficiently elevated relative to the U-shaped dock 150 and/or water level 102 that the barrel vault 580 offers enclosed and unobstructed access to the moored watercraft with entry via the door gaps 533 (described in further detail below), or via the vertical sides of the barrel vault 580. As a result of the above-described configuration, embodiments of the barrel vault 580 provides sufficient elevation and unobstructed enclosure that users of moored watercraft may stand up and move around while docked under the barrel vault 580, which may therefore be understood as a watercraft shelter, rather than a mere watercraft cover.

The arch tubular right angle connector 515 includes a first arch tubular right angle connector annular opening 515B and a second arch tubular right angle connector annular opening 515C, fixed at right angles to one another. The first arch tubular right angle connector annular opening 515B conforms to the upper horizontal support 514, which may be slidably inserted therein and releasably retained via one or more embedded bolts 515A. Similarly, the second arch tubular right angle connector annular opening 515C conforms to the arch member 520, which is disposed therein allowing the tubular right angle connector 515, and thus the arch member 520, to slide relative to the upper horizontal support 514. The arch member 520 may be releasably fixed to the arch tubular right angle connector 515 via one or more embedded bolts 515A.

Referring still to the embodiments of FIGS. 6-9, and FIG. 12, the canopy frame 500, 600, 700, 800, or 900 may include at least two horizontal members 530 or 532. Long lower horizontal members 530 may extend the full length of the canopy frame 500 or may be composed of one or more first horizontal component members 530A and second horizontal component members 530B, joined end to end. Short lower horizontal members 532 may be positioned along a portion of the length of the canopy frame 500, leaving a door gap 533. Either type of lower horizontal support 530 or 532 is affixed to the outer end of at least one of the plurality of arch member 520 via an arch tubular T-connector 517. In embodiments where a door gap 533 is present, a door gap horizontal member 534 spans the door gap 533 at an elevation higher than the short lower horizontal members 532, but lower than the upper horizontal supports 514, as shown. The door gap horizontal member 534 may be affixed to the arch members 520 via arch tubular T-connectors 517, also as shown. At the corners of the barrel vault 580, or at the door gaps 533, the lower horizontal members 530 or 532 may be affixed to the arch members 520 via a terminal right-angle connector 516, which accepts the terminal ends of two tubular members at a single right angle, as shown. The locations of arch tubular T-connectors 517 and angle connectors 516 at the ends of the arch members 520 may be understood to define outer attachment points for the lower horizontal members 530 or 532.

Referring still to the embodiments of FIGS. 6-9, and FIG. 12, the arch tubular T-connectors 517 each include embedded bolts 517A. At least one of the embedded bolts 517A secures anything inserted through an arch tubular T-connector annular opening 517B, such as one of lower horizontal supports 530 or 532 or one of the arch members 520. At least one of the embedded bolts 517A secures anything inserted into an arch tubular T-connector terminal opening 517C, such as the arch member 520 or door gap horizontal member 534.

Referring still to the various embodiments depicted in FIGS. 6-9, and FIG. 12, the various components (vertical support 1000, arch members 520) may be at least two in number and repeated an arbitrary number of times to comprise a canopy of any length. Specifically, the vertical supports 1000 may support any length of upper horizontal supports 514 and, where distal supports 1006 are present, of lower horizontal members 530 or 532, and with any number of door gaps 533 between any two of the arch supports 520. In particular, the first lower horizontal members 530A may be at a maximum length convenient for economical pre-assembly transport, for example nine feet (in some embodiments/applications, transport of a twelve-foot member may be economical), with second lower horizontal support members 530B being shorter, for example at six feet. In such a system, short horizontal support members 532 may be six feet in length, and door gap horizontal members 534 may be three feet in length, with the arch members 520 being positioned three feet apart. Such dimensions are given by way of example only, and any combination of compatible lengths may be chosen for any given embodiment. The exemplary set of lengths given above, however, may be understood to provide a modular capability for design variations in the various embodiments 500, 600, 700, 800, and 900.

Figure 16A:
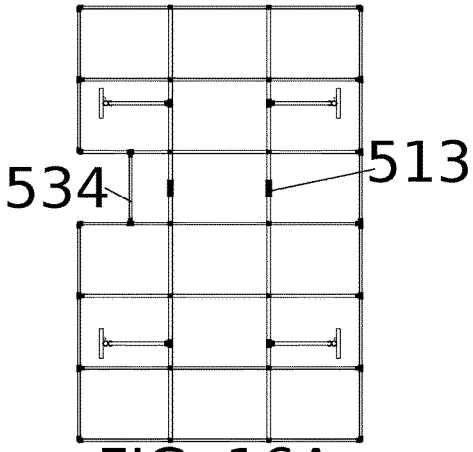
FIG. 16A is a plan view of a canopy frame with a left side door off the longitudinal center and intermediate overall length.
Figure 16B:
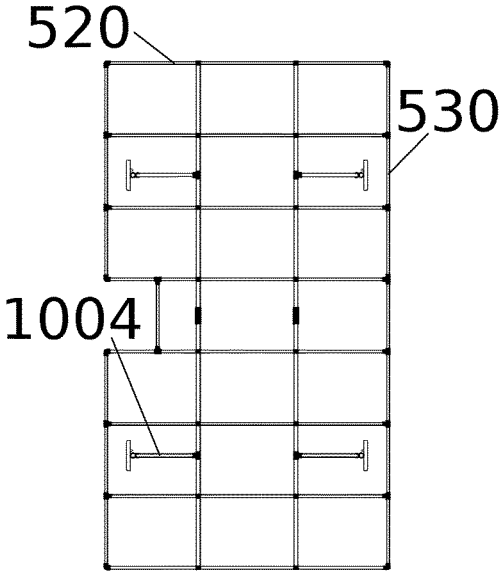
FIG. 16B is a plan view of a canopy frame with a left side door longitudinally centered and long overall length.
Figure 16C:
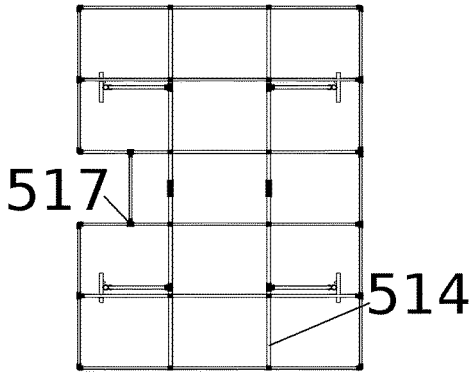
FIG. 16C is a plan view of a canopy frame with a left side door longitudinally centered and short overall length.
Figure 16D:
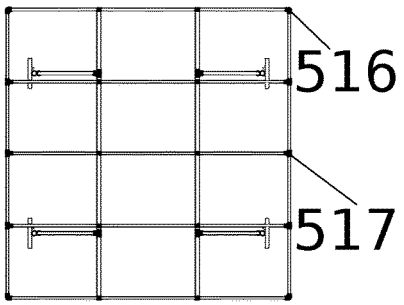
FIG. 16D is a plan view of a canopy frame with no side door and short overall length.

Referring still to the embodiments depicted in FIGS. 6-9, and to the plan views of FIGS. 16A-16E, FIGS. 5-6 depict a canopy 500 or 600 (canopy 600 lacks the distal supports 1006) of intermediate length with a left side door opening, in a configuration corresponding to the plan view of FIG. 16C. In exemplary dimensions, the canopy 500 may be understood as fifteen feet long, with the long lower horizontal member 530 being composed of one six-foot component and one nine-foot component joined end-to-end within one of the arch tubular T-connectors 517. Similarly, the short lower horizontal members 532 may be understood as each six feet long with the door gap 533 three feet long. Such an embodiment may be installed on a U-shaped dock 150 having about fifteen feet of partially surrounded mooring area. As shown, since the vertical supports 1000 are positioned relatively inwards of the ends of the barrel vault, and since only the vertical supports 1000 need be positioned against the inner surfaces of the arms of the U-shaped dock 150, the length of the barrel vault 580 need not conform exactly to the length of the U-shaped dock 150.

Figure 16E:
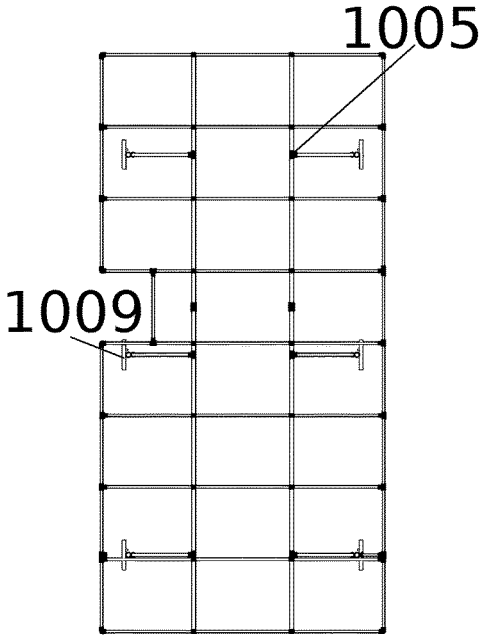
FIG. 16E is a plan view of a canopy frame with a left side door off the longitudinal centered and long overall length.

Similarly, the canopy 700 is of intermediate length, but with an additional door gap 533 on the right side. The canopy 800 is also of intermediate length, but with no door gaps 533. The canopy 900 is of reduced length, also with no door gaps, and corresponds in plan to FIG. 16D. FIG. 16A provides a plan for an overall longer (e.g., 18 feet, in the above-described modular system) canopy with an off-center door gap. FIG. 16B provides a plan for an overall long (e.g. 21 feet, in the above-described modular system) canopy with a centered door gap. FIG. 16E provides a plan for an overall very long (e.g., 24 feet, in the above-described modular system) canopy with an off-center door gap. Practitioners of various embodiments will appreciate that many variations are possible depending on the length of the dock and desired locations for entry and egress.

Figure 14A:
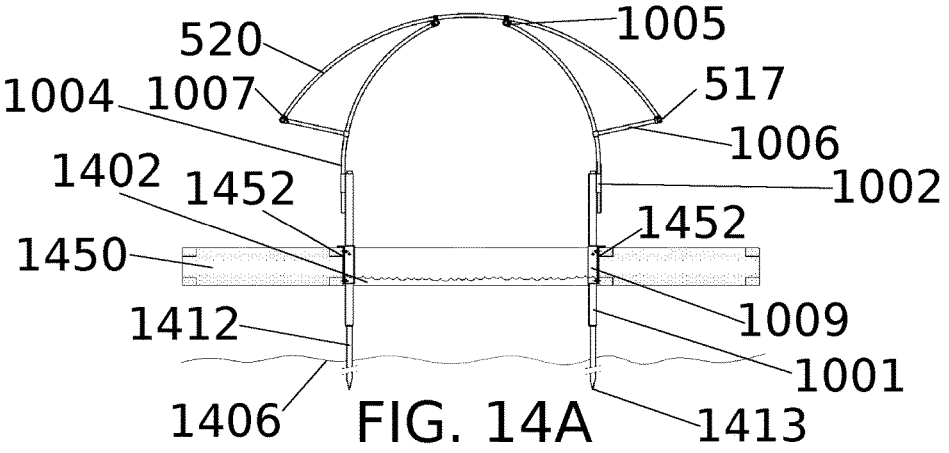
FIG. 14A is a front sectional view of a canopy structure installed on a U-shaped dock covering a short span, with distal support members installed and the canopy supports augured to the water body bed, in accordance with at least one embodiment of the present invention.
Figure 14B:
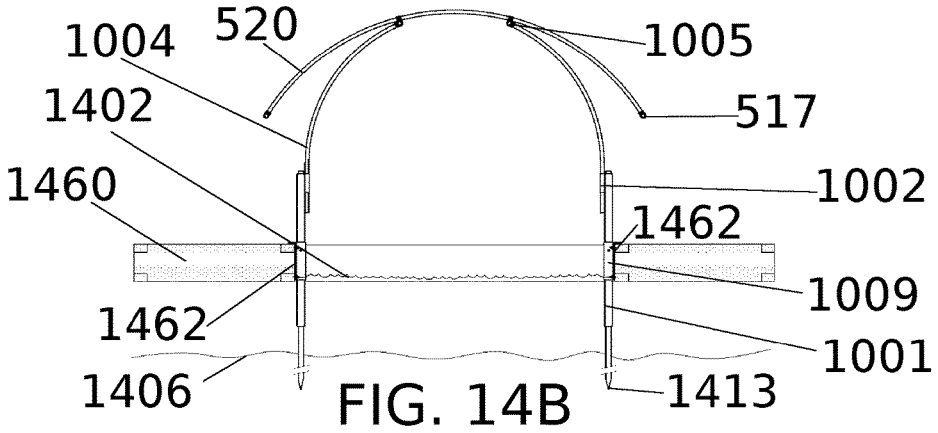
FIG. 14B is a front sectional view of a canopy structure installed on a U-shaped dock covering an intermediate span and the canopy supports augured to the water body bed, in accordance with at least one embodiment of the present invention.
Figure 14C:
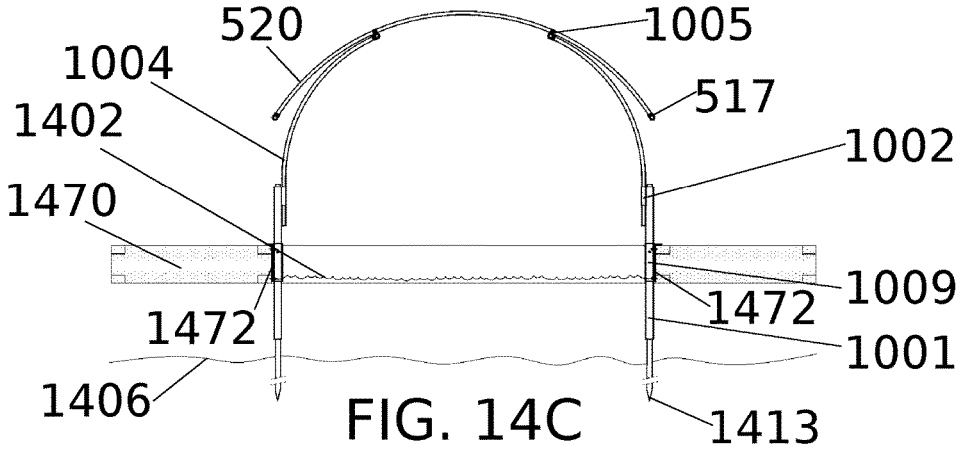
FIG. 14C is a front sectional view of a canopy structure installed on a U-shaped dock covering a long span and the canopy supports augured to the water body bed, in accordance with at least one embodiment of the present invention.
Figure 15A:
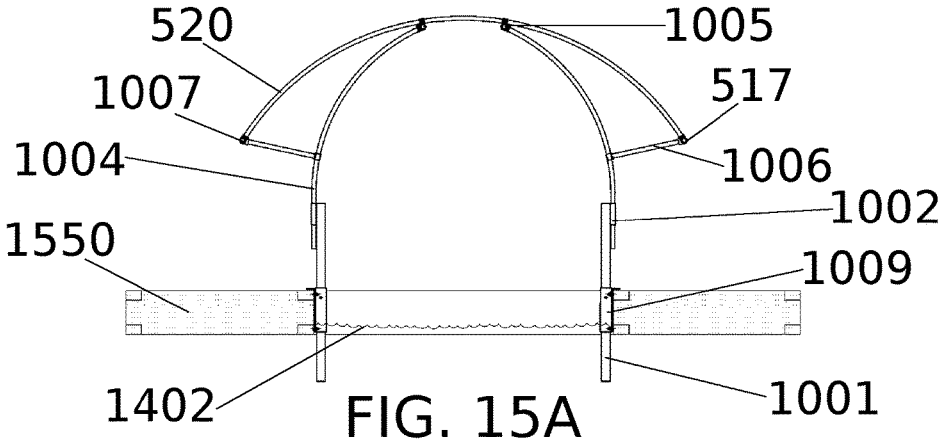
FIG. 15A is a front sectional view of a canopy structure installed on a U-shaped dock covering a short span, with distal support members installed and the canopy supports not augured to the water body bed, in accordance with at least one embodiment of the present invention.
Figure 15B:
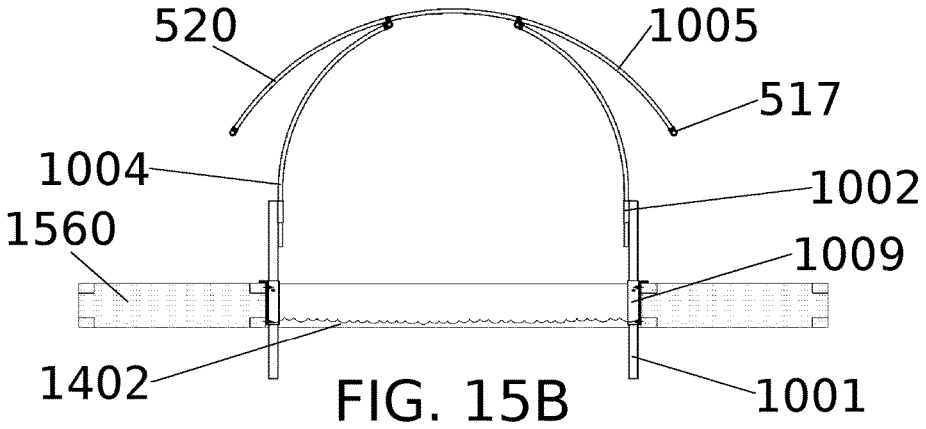
FIG. 15B is a front sectional view of a canopy structure installed on a U-shaped dock covering an intermediate span and the canopy supports not augured to the water body bed, in accordance with at least one embodiment of the present invention.
Figure 15C:
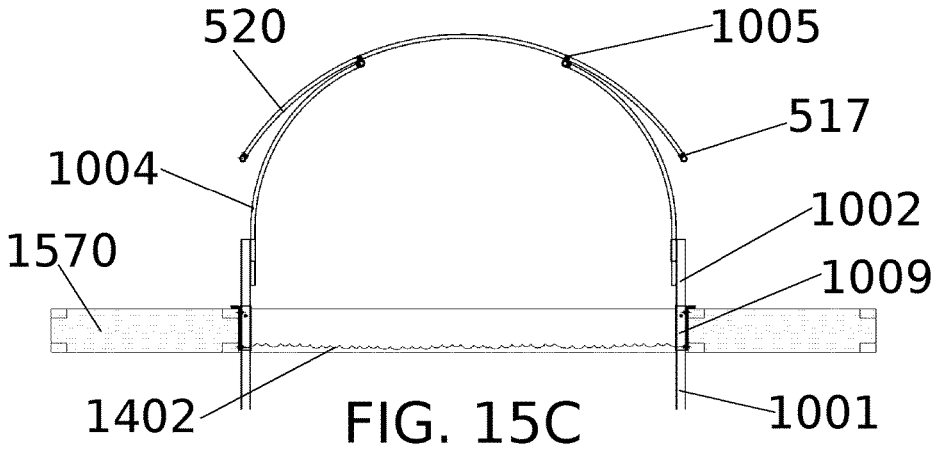
FIG. 15C is a front sectional view of a canopy structure installed on a U-shaped dock covering a long span and the canopy supports not augured to the water body bed, in accordance with at least one embodiment of the present invention.

In FIGS. 14A-14C, augur poles 1412 are affixed to and/or inserted into the vertical members 1001 and are augured into the water body bed 1406 via augur tips 1413, fixing the vertical supports 1000 to the water body bed 1406. The configuration of FIGS. 14A-14C may be used when the dock 1460 is insufficiently sturdy o support the canopy structure. In alternative embodiments, the canopy structure need not be mounted to the dock 1460 at all, and may be only augured to the water body bed 1406. In FIGS. 15A-15C, no augur poles are present, as in a floating dock configuration, allowing the dock and canopy structure to vary with the water level 1502.

Referring now to FIGS. 14A-15C, various embodiments of the invention may be configured to span varying widths of the U-shaped dock 150. For the embodiment of FIG. 14A, the U-shaped dock 1450 has a relatively narrow span, for example eight feet. The vertical supports 1000 are affixed to the dock arm inner edges 1452 located on opposite sides of the mooring area via the brackets 1009 and appropriate fasteners. The span is adjusted-for by sliding the upper horizontal supports 514 relatively close together. Thus, the distal supports 1006 slidably link the vertical supports 1000 to the lower horizontal members 530 or 532 in a manner effective to reduce unintended and/or dynamic deflection of the arch members 520. The distal supports 1006 may be adjusted to varying distance between the vertical supports 1000 and the lower horizontal members 530 or 532 by adjusting tubular right angle connector 1003, allowing the distal support member 106 to be slid to an elevation, angle, and length corresponding to the elevation of the lower horizontal members 530 or 532 and arch members 520, respectively. FIG. 15A provides a similar configuration with U-shaped floating dock 1550.

FIG. 14B depicts an embodiment wherein U-shaped dock 1460 has an intermediate span, for example, ten feet. The vertical supports 1000 are affixed to the dock arm inner edges 1462 via the brackets 1009. The intermediate span is adjusted for by sliding the upper horizontal supports 514 relatively outward compared to FIG. 14A along the arch members 520. Since the steepness of the arch members 520 is reduced as compared with FIG. 14A, the distal support members 1006 are unnecessary and may be omitted, as shown. FIG. 15B depicts a similar configuration for U-shaped floating dock 1560.

FIG. 14C depicts an embodiment wherein U-shaped dock 1470 has a long span, for example, twelve feet. The vertical supports 1000 are affixed to the dock arm inner edges 1472 via the brackets 1009. The long span is adjusted for by sliding the upper horizontal supports 514 relatively outward compared to FIG. 14B along the arch members 520. Since the steepness of the arch members 520 is reduced as compared with FIG. 14A, the distal support members 1006 are unnecessary and may be omitted, as shown. FIG. 15C depicts a similar configuration for U-shaped floating dock 1570.

Accordingly, in various embodiments as shown in FIGS. 14A-15C, the at least two pluralities (rows) of vertical supports 1000 are adjustably separated from one another in conjunction with different spans of the U-shaped dock. The adjustments may be understood as effective to accommodate variations in mounting width between the pluralities of vertical supports 1000. Equivalently, the vertical supports 1000 may be understood to be adjustably affixed to the canopy frame 500, 600, 700, 800, or 900, effective to accommodate variations in distance between the inner dock arm edges 1452, 1462, or 1472. Correspondingly, the barrel vault 580 is of adjustable height caused by variations in or adjustments to the mounting width of the pluralities of vertical supports 1000, which causes the barrel vault 580 to rise or lower with the vertical supports' 1000 positions on the arch members 520.

In various embodiments, connections between the elements of the canopy frame may be achieved by any known or later discovered means, and the elements of the canopy frame may be of any material or shape profile. However, in various embodiments, the structural elements, specifically the vertical members 100, the arched support members 1004, the distal support members 1006, the upper horizontal supports 514, the arch members 520, the long lower horizontal members 530, the short lower horizontal members 532, and the door gap horizontal members 534 are all made of galvanized steel pipe or beam, or alternative materials such as aluminum, composite, plastic, or wood. The frame elements may be manufactured to length or, in some embodiments, are assembled from short modular segments, as described above, such that the entire frame is easily transported, assembled, and stored. Those frame elements that are hollow are preferably pierced with weep holes providing for the drainage and evaporation of internally accumulated moisture.

The connections between the aforementioned structural components may be formed with the pipe or beam connectors 1003, 1005, 1007, 513, 515, 516 and 517. The various embedded bolts may be threaded to accommodate manufactured holes in the various connector components, and may be headed with Alan-type heads or otherwise. the Applicant has identified and applied commercially available Kee Klamp® brand connectors with success in the context of the present invention.

Figure 13:
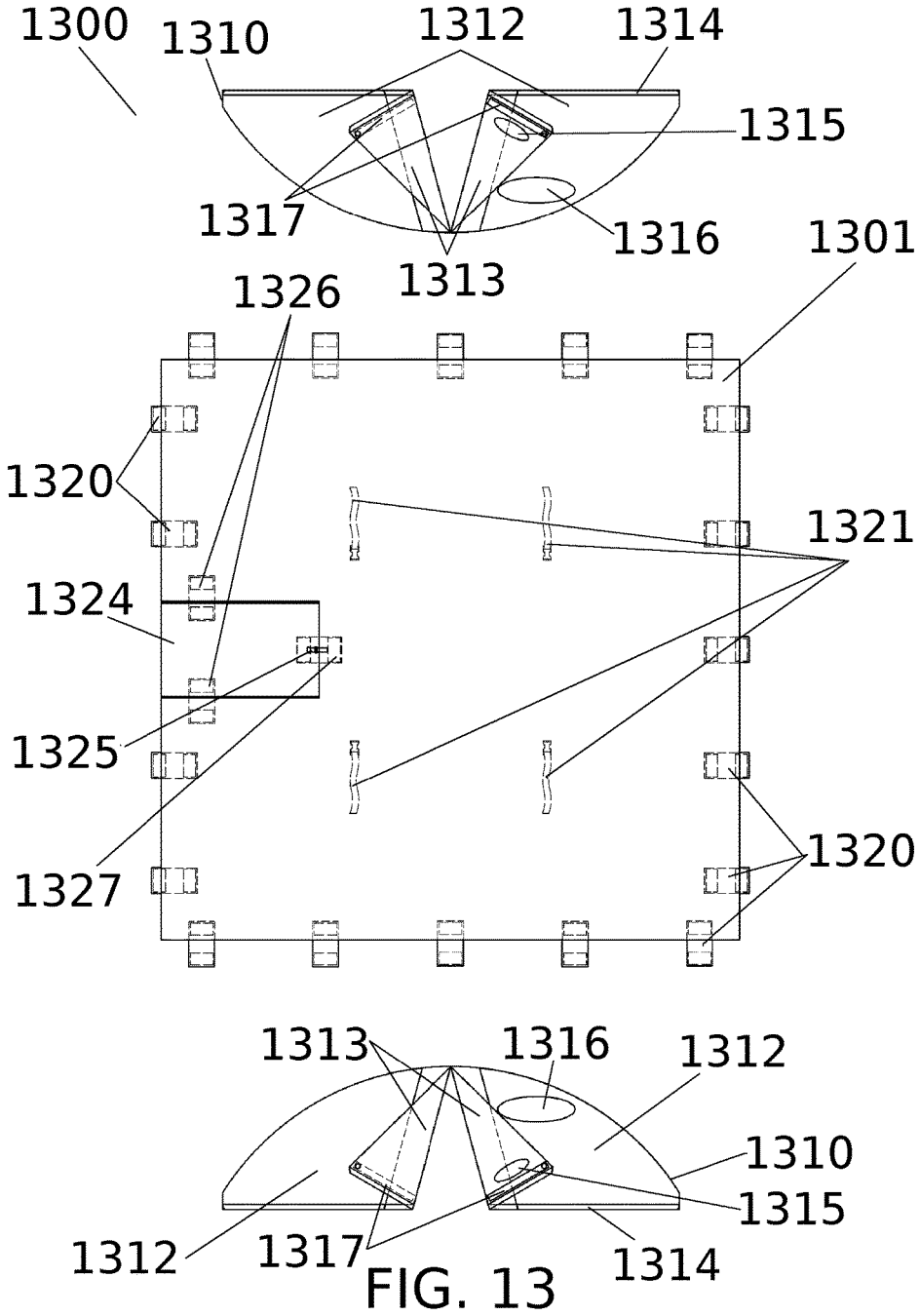
FIG. 13 is a plan view of a canopy cover, in accordance with at least one embodiment of the present invention.

Referring now to the canopy cover 1300, shown in disassembled plan view in FIG. 13, the an embodiment of the canopy comprises a canopy top element 1301. The canopy cover 1300 may further include a pair of canopy side elements 1310, which form the ends of the barrel vault 580. Each canopy side element 1310 includes a pair of canopy side flap elements 1312, which overlap adjustably in an overlap region 1313, fastened, adjustably, by a hook and loop fastener strip 1317. The adjustable fastening function of the canopy side flap elements may provide for fault tolerance of the degree of deflection of the arch members 520, and may serve to "blow out" in high winds or storm conditions, relieving pressure on the overall canopy structure, while finding one another and refastening as conditions improve. The curved top edges of the canopy side elements 1310 are shaped to match the arc of the arch members 520. The outside surface of the canopy side elements 1310 may have affixed thereto a logo placement 1316 whereon branding or other indicia may be printed. A similar logo placement 1315 may be located on the interior surface of the overlap region 1313, as shown.

Additionally, the canopy top element 1301 as well as the canopy side elements 1310 may have affixed to their lower edges a loosely hanging skirt 1314 of additional material, which may provide added protection against the entry of dirt, wind, and moisture. Together, the canopy top element 1301 and canopy side elements 1310 may be understood to form the canopy cover 1300, which may be removably affixed to and substantially covering the canopy frame 500, 600, 700, 800, or 900.

The canopy components 1301 and 1310 may joined by canopy cover fasteners, such as stitching, zippers, hook and loop fastener strips, buttons, snaps, etc. The canopy cover 1300 affixes to the canopy frame 500, 600, 700, 800, or 900 via outer cover fastener loops 1320, which may be fastened to themselves by hook and loop fastener strips, snaps, buttons, zippers, etc., around the lower horizontal supports 530 or 532 and the outermost of the arch members 520. Inner cover fastener loops 521 may similarly fasten to themselves around the upper horizontal supports 514 or some of the inner arch members 520.

Referring still to the canopy cover plan depicted in FIG. 13, rollable door flaps 1324 may be included to cover the door gaps 533. The rollable door flaps 1324 may be retained in a closed configuration by buttons, snaps, hook-and-loop fasteners, etc., or in an open configuration (FIGS. 1-4) by a rollable door flap fastener 1325, which may be one or more straps, hook-and-loop fasteners, ties, etc. Additionally, around the door gaps 533 may be door gap side fastening loops 1326, which fasten to those of the arch members 520 that are located on either side of the door gaps 533. Also, a door gap upper fastening loop 1327 may fasten around the door gap horizontal member 534. Both the door gap side fastening loops 1326 and the door gap upper fastening loop 1327 may be fastened by buttons, snaps, zippers, hook-and-loop fastener strips, etc.

Figure 2:
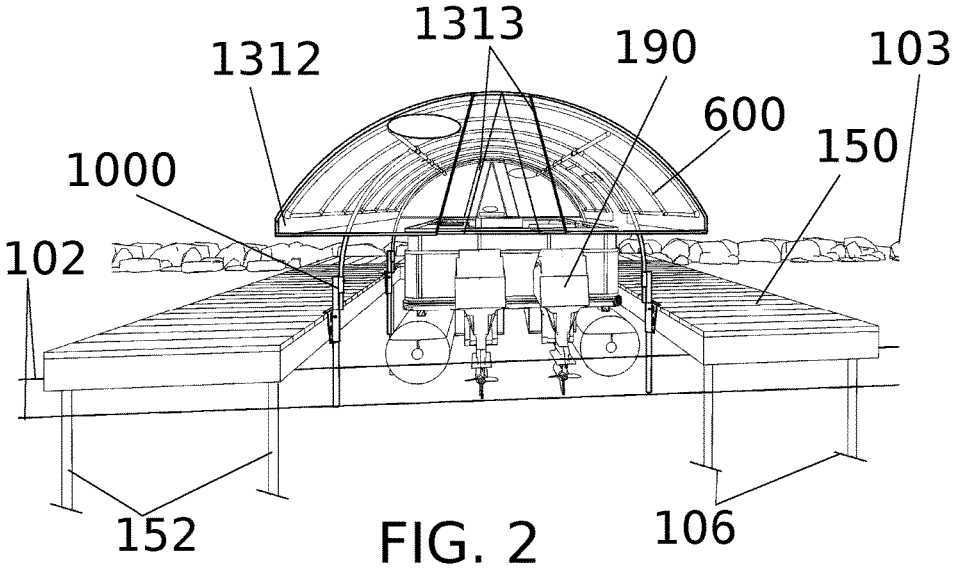
FIG. 2 is an elevated front perspective scene view of a watercraft canopy installed on a U-shaped dock, in accordance with at least one embodiment of the present invention.
Figure 3:
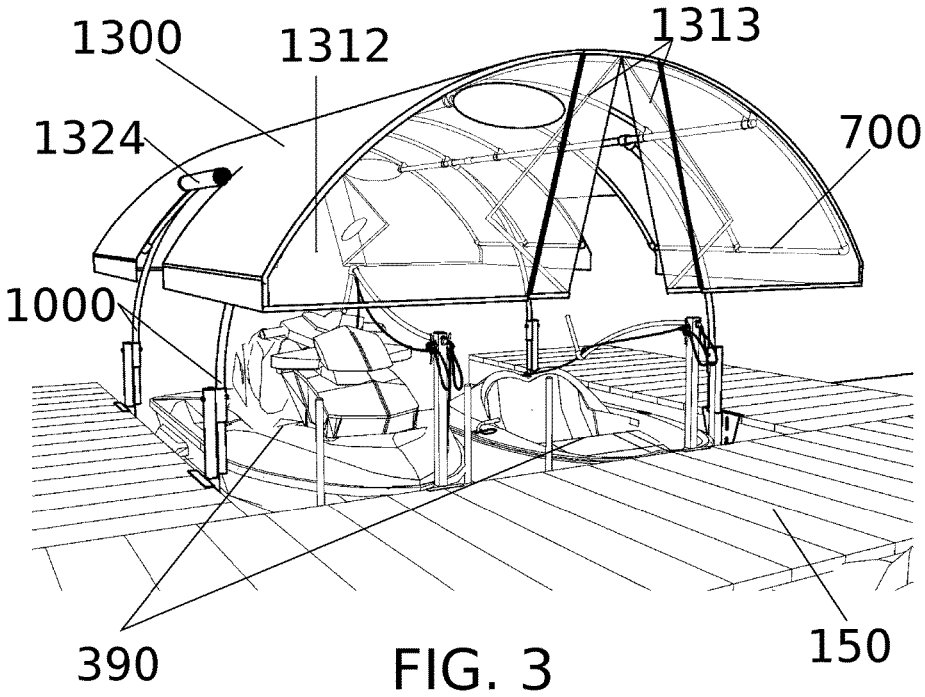
FIG. 3 is an elevated rear-left perspective scene view of a watercraft canopy installed on a U-shaped dock with two exemplary small watercraft moored therein, in accordance with at least one embodiment of the present invention.
Figure 4:
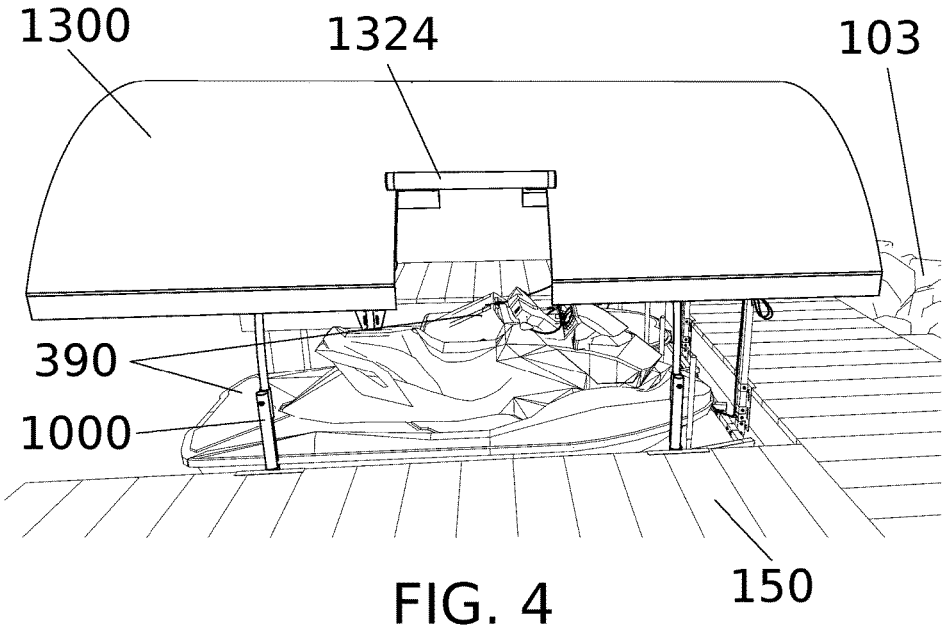
FIG. 4 is an elevated left perspective scene view of a watercraft canopy installed on a U-shaped dock with two exemplary small watercraft moored therein, in accordance with at least one embodiment of the present invention.
Figure 5:
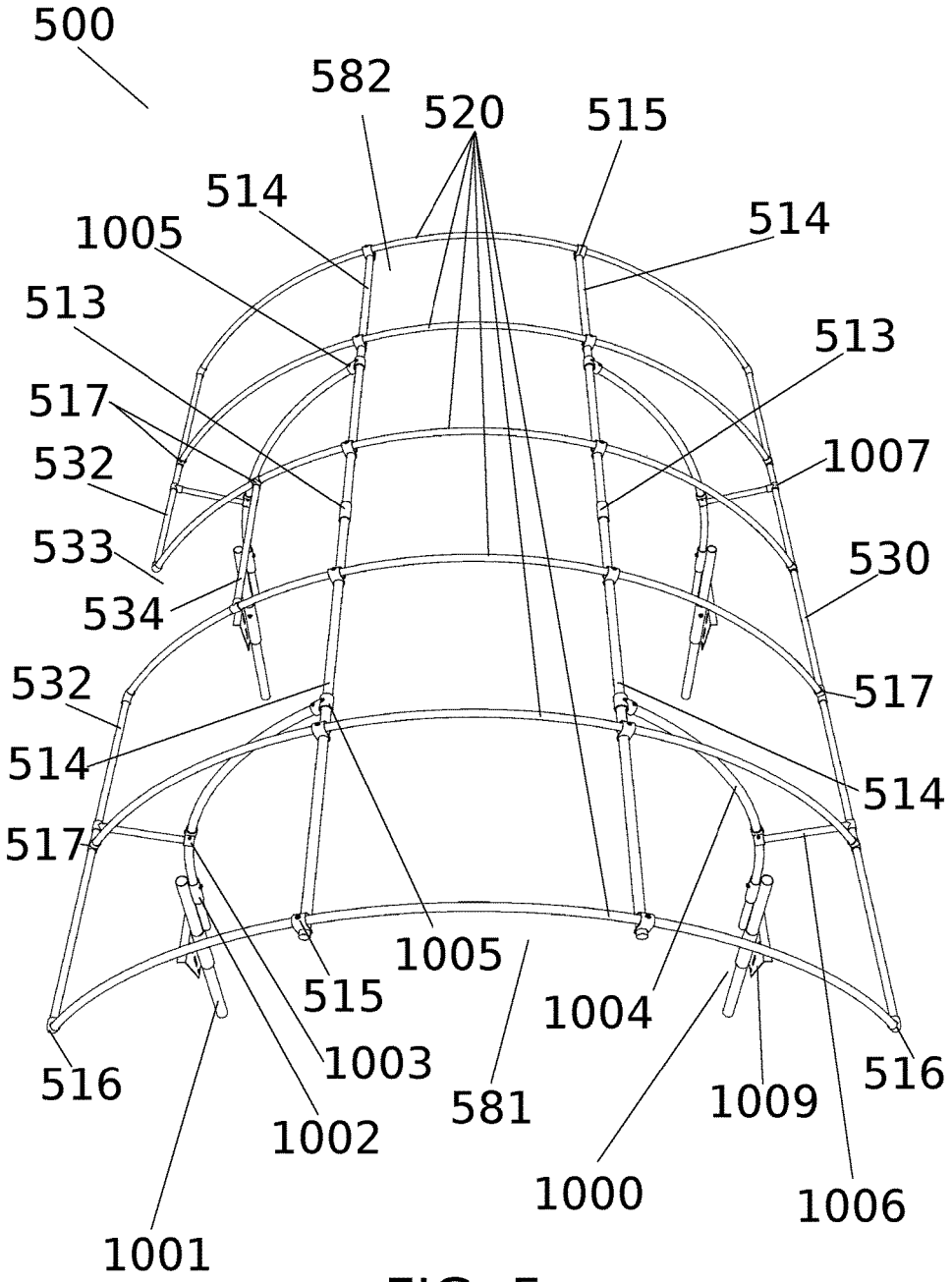
FIG. 5 is an elevated view of a canopy frame with a left side door opening and distal support members installed, in accordance with at least one embodiment of the present invention.
Figure 6:
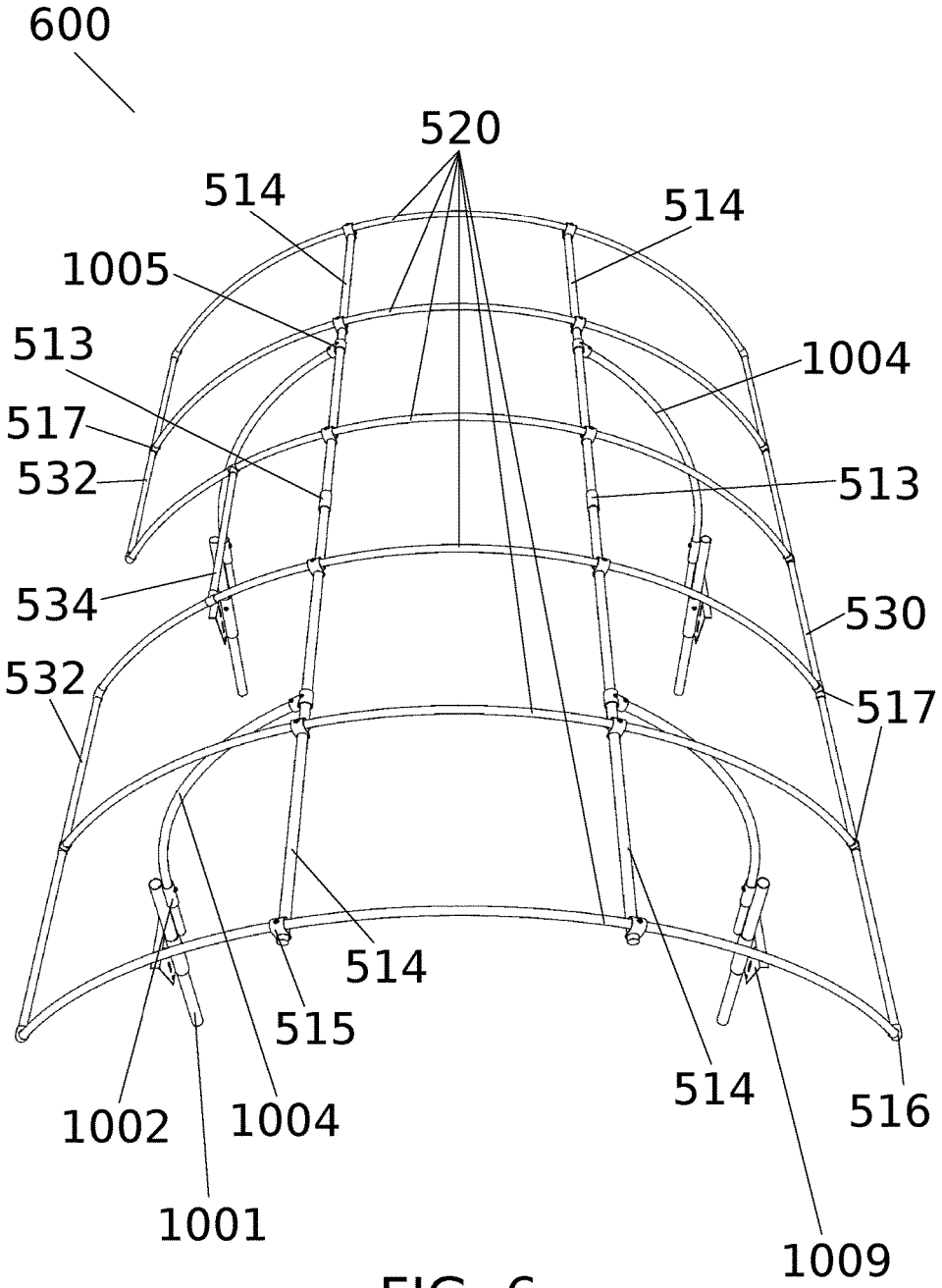
FIG. 6 is an elevated view of a canopy frame with a left side door opening without distal support members installed, in accordance with at least one embodiment of the present invention.
Figure 7:
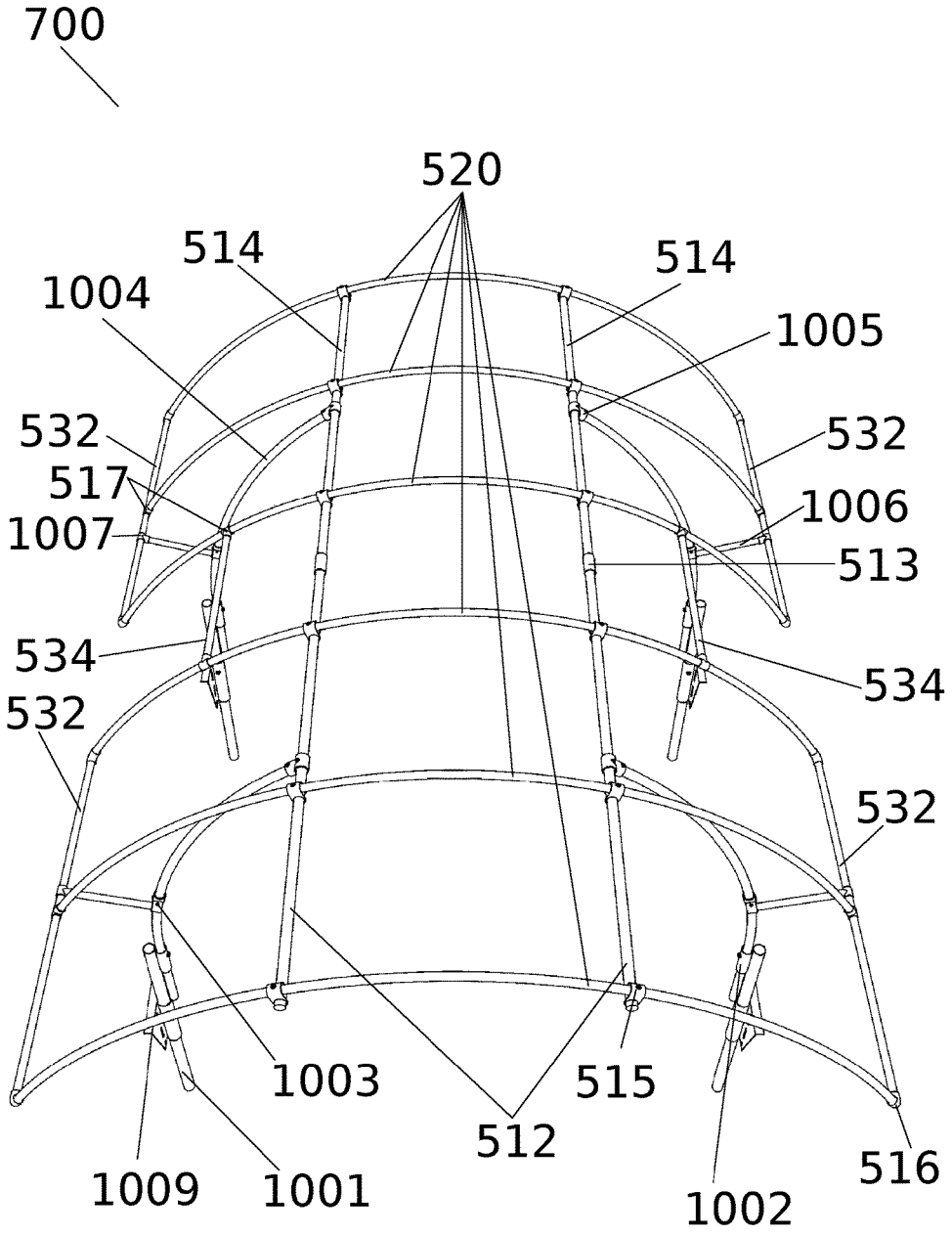
FIG. 7 is an elevated view of a canopy frame with side door openings on both sides, in accordance with at least one embodiment of the present invention.
Figure 8:
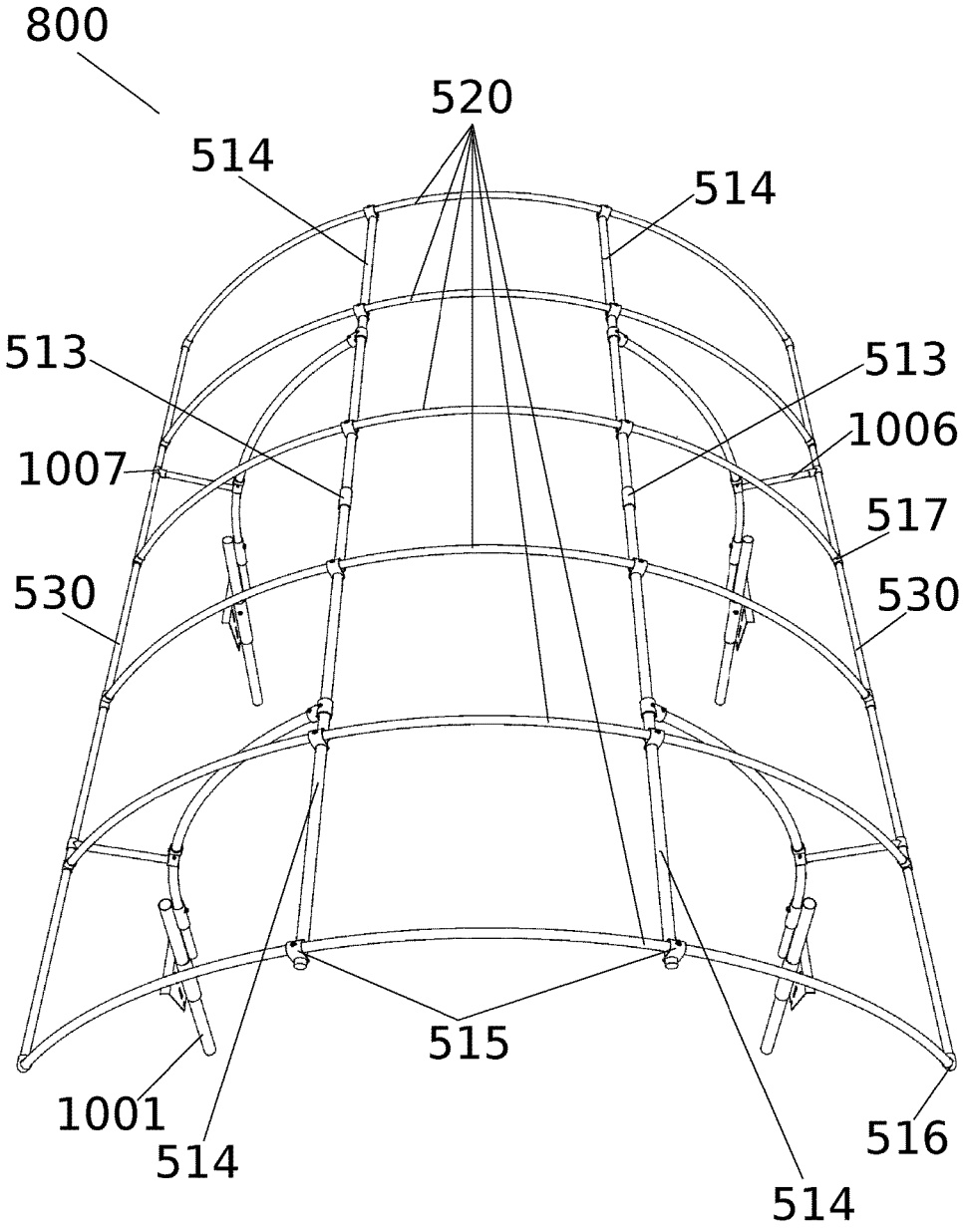
FIG. 8 is an elevated view of a canopy frame with no side door openings, in accordance with at least one embodiment of the present invention.
Figure 9:
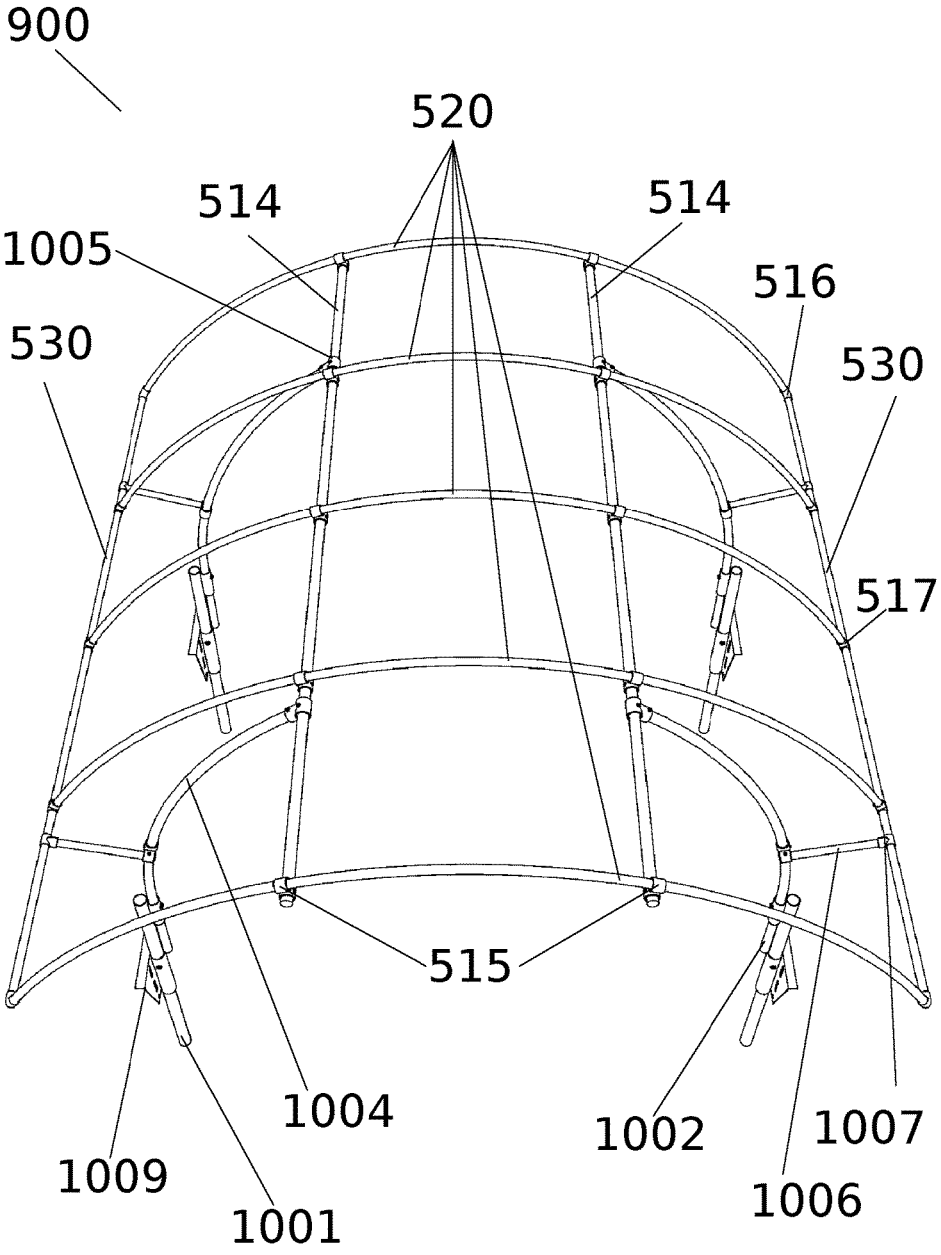
FIG. 9 is an elevated view of a canopy frame of reduced length, in accordance with at least one embodiment of the present invention

The canopy cover 1300 and its sub-parts may be made from a waterproof or water resistant vinyl, canvas, or other fabric covering. In the depicted embodiment of FIG. 13, however, the canopy side elements 1310, may be made of a transparent material, for example, a transparent mesh fabric material or a clear vinyl material. FIGS. 2-3 display the transparency effect in scene view. The transparency allows light to enter such that the user can see the surrounding area during daylight via the side elements 1310, and to see the contents of the canopy from outside or approaching persons or watercraft from inside.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A structure, comprising:

a plurality of parallel arch members defining a barrel vault;

at least two upper horizontal members;

each of said at least two upper horizontal members being affixed to at least two of said plurality of parallel arch members at an inner attachment point thereof;

at least two pluralities of vertical supports;

said at least two upper horizontal supports being affixed to said at least two pluralities of vertical supports; and at least two lower horizontal members; and each of said at least two lower horizontal members being affixed to at least two of said plurality of parallel arch members at an outer attachment point thereof;

wherein said at least two upper horizontal members are slidably affixed to said plurality of parallel arch members such that said inner attachment point is adjustable along said plurality of parallel arch members.

2. The structure of claim 1, further comprising at least one distal support member, said distal support member being affixed to one of said vertical supports and to one of said lower horizontal supports.

3. The structure of claim 2, wherein said distal support member is effective to reduce deflection of said plurality of parallel arch members.

4. The structure of claim 2, wherein said distal support member is slidably affixed to said one of said vertical supports.

5. The structure of claim 1, wherein said at least two upper horizontal members are affixed to said plurality of arch members via tubular right-angle connectors secured using one or more embedded bolts.

6. The structure of claim 1, wherein said at least two pluralities of vertical supports are affixed to at least two inner dock arm edges of a u-shaped dock surrounding a watercraft mooring area.

7. The structure of claim 6, wherein said barrel vault is covered by a canopy cover such that said barrel vault provides enclosed and unobstructed access to one or more watercraft moored in said watercraft mooring area.

8. The structure of claim 6 wherein said at least two pluralities of vertical supports are augured to a water body bed located below said watercraft mooring area.

9. A structure, comprising:

a plurality of parallel arch members defining a barrel vault;

at least two upper horizontal members;

each of said at least two upper horizontal members being affixed to at least two of said plurality of parallel arch members at an inner attachment point thereof;

at least two pluralities of vertical supports;

said at least two upper horizontal supports being affixed to said at least two pluralities of vertical supports; and at least two lower horizontal members; and each of said at least two lower horizontal members being affixed to at least two of said plurality of parallel arch members at an outer attachment point thereof;

wherein said at least two pluralities of vertical supports are adjustably separated from one another, effective to accommodate variations in mounting width therebetween.

10. The structure of claim 9, wherein said barrel vault is of adjustable height, depending upon said variations in mounting width between said at least two pluralities of vertical supports.

11. A structure, comprising:

a u-shaped dock surrounding a watercraft mooring area and comprising at least two inner dock arm edges located on opposite sides of said watercraft mooring area;

at least two vertical supports affixed to at least two of said inner dock arm edges; and said at least two vertical supports supporting a canopy frame;

wherein said canopy frame comprises a plurality of parallel arch members defining a barrel vault and at least two upper horizontal members affixed to at least two of said plurality of parallel arch members, said at least two upper horizontal members being supported by said at least two vertical supports;

at least two lower horizontal members; and each of said at least two lower horizontal members being affixed to at least two of said plurality of parallel arch members at an outer attachment point thereof.

12. The structure of claim 11, wherein said at least two vertical supports are adjustably affixed to said canopy frame, effective to accommodate variations in distance between said at least two inner dock arm edges.

13. The structure of claim 12, wherein said barrel vault is of adjustable height, depending upon said variations in distance of said at least two vertical supports.

14. The structure of claim 11, further comprising at least one distal support member, said distal support member being slidably affixed to one of said vertical supports and to an outer edge of said canopy frame.

15. The structure of claim 14, wherein said distal support member is effective to reduce deflection of said canopy frame.

16. The structure of claim 14, wherein said distal support member is slidably affixed to said one of said vertical supports.

17. The structure of claim 11, wherein said at least two vertical supports are affixed to said at least two upper horizontal members, said at least two upper horizontal members being affixed to said canopy frame via tubular right-angle connectors secured using one or more embedded bolts.

18. The structure of claim 11, wherein said at least two vertical supports are augured to a water body bed located below said watercraft mooring area.

19. The structure of claim 11, wherein said at least two upper horizontal members are slidably affixed to said plurality of parallel arch members such that said inner attachment point is adjustable along said plurality of parallel arch members.

* * * * *